US007011560B2

(12) United States Patent
Downs et al.

(10) Patent No.: US 7,011,560 B2
(45) Date of Patent: Mar. 14, 2006

(54) SPARK PLUG WITH GROUND ELECTRODE HAVING MECHANICALLY LOCKED PRECIOUS METAL FEATURE

(75) Inventors: Darren C. Downs, Northwood, OH (US); Michael E. Garrett, Toledo, OH (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 197 days.

(21) Appl. No.: 10/702,378

(22) Filed: Nov. 5, 2003

(65) Prior Publication Data

US 2005/0093413 A1 May 5, 2005

(51) Int. Cl.
*H01T 21/02* (2006.01)

(52) U.S. Cl. ..... 445/7; 445/46; 313/141

(58) Field of Classification Search ..... 445/7, 445/46; 313/141, 142; 29/33 N
See application file for complete search history.

(56) References Cited

U.S. PATENT DOCUMENTS 4,023,058 A * 5/1977 Lara et al. ..... 313/139
4,414,483 A * 11/1983 Nishio et al. ..... 313/136
4,670,684 A 6/1987 Kagawa et al.
4,743,793 A 5/1988 Toya et al.
4,771,210 A * 9/1988 Mohle et al. ..... 313/141
5,347,193 A 9/1994 Oshima et al.
5,493,171 A 2/1996 Wood, III et al.
5,510,667 A * 4/1996 Loffler et al. ..... 313/141
5,982,080 A 11/1999 Shibata et al.
5,998,912 A * 12/1999 Schwab ..... 313/118
5,998,913 A 12/1999 Matsutani
6,078,129 A 6/2000 Gotou et al.
6,337,533 B1 1/2002 Hanashi et al.
6,346,766 B1 2/2002 Kanao et al.
6,412,465 B1 7/2002 Lykowski et al.
6,533,629 B1 * 3/2003 Boehler et al. ..... 445/7
2001/0030494 A1 10/2001 Kano
2001/0030495 A1 10/2001 Kano et al.
2002/0074920 A1 6/2002 Chiu et al.

FOREIGN PATENT DOCUMENTS

EP 1 139 530 A2 10/2001
EP 1 244 189 A2 9/2002
WO WO 02/065601 A1 8/2002

* cited by examiner

*Primary Examiner*—Joseph Williams
*Assistant Examiner*—Kevin Quarterman
(74) *Attorney, Agent, or Firm*—Edmund P. Anderson

(57) ABSTRACT

A ground electrode for a spark plug has a through hole located adjacent a firing end of the electrode, with a precious metal firing tip extending through the hole. The firing tip is compressed axially to define a bulging portion extending radially outwardly from its longitudinal axis to mechanically retain the firing tip within the through hole. The firing tip additionally has an enlarged head or otherwise expanded portion at each axial end of the tip to provide a second mechanical interlock of the tip to the ground electrode. The firing tip can then also be welded to further strengthen its connection to the ground electrode. A method of manufacturing the ground electrode and a spark plug containing the ground electrode is also disclosed.

13 Claims, 1 Drawing Sheet

SPARK PLUG WITH GROUND ELECTRODE HAVING MECHANICALLY LOCKED PRECIOUS METAL FEATURE

BACKGROUND OF THE INVENTION

This invention relates generally to spark plugs for internal combustion engines, and particularly to the construction of ground electrodes for such spark plugs.

RELATED ART

Spark plugs for use in internal combustion engines typically have a center electrode and a ground electrode with a predefined gap therebetween. It is desirable to maintain the predefined gap distance so that a predictable and repeatable spark can arc between the two electrodes. To improve the useful life of a spark plug, it is known to incorporate precious metals, i.e. iridium-based alloys, platinum alloys, or other precious metals, on the electrodes to maintain the predetermined gap and to resist erosion in use. To ensure that the precious metal maintains the desired gap, it is beneficial to secure the precious metal to the electrode such that the precious metal does not become dislodged or move from its fixed position. To further maintain the desired gap, it is desirable to maximize the surface area of the precious metal exposed to the gap. As disclosed in U.S. Pat. No. 4,771,210 to K. Möhle et al., it is known to insert an electric discharge pad or firing tip in a through bore of a ground electrode and either laser or argon arc weld the firing tip to the electrode. Further, this patent discloses applying a radial load through opposite sides of the ground electrode perpendicular to an axis of the bore to plastically deform the ground electrode inwardly toward the firing tip in a pinched fashion to capture the firing tip.

SUMMARY OF THE INVENTION

A spark plug for an internal combustion engine has a ground electrode disposed adjacent a central electrode defining a spark gap therebetween. The ground electrode has a through hole extending axially toward the center electrode at the spark gap. A firing tip having a longitudinal axis is received at least in part in the through hole and the firing tip is compressed axially along its longitudinal axis to define a bulging portion extending radially outwardly from the longitudinal axis to mechanically retain the firing tip within the through hole.

In accordance with another aspect of the invention, there is provided a spark plug and a ground electrode therefore in which a firing tip is mechanically interlocked within a through hole in the ground electrode by engagement of an enlarged head or otherwise expanded portion of the firing tip with an outer surface of the ground electrode at each end of the firing tip.

Yet another aspect of the invention provides a method of constructing a ground electrode for a spark plug. The method includes providing a segment of metal wire and forming a through hole extending between generally opposite surfaces of the wire. A firing tip having a longitudinal axis is inserted within the through hole and then compressed along its longitudinal axis to mechanically secure the firing tip within the through hole.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
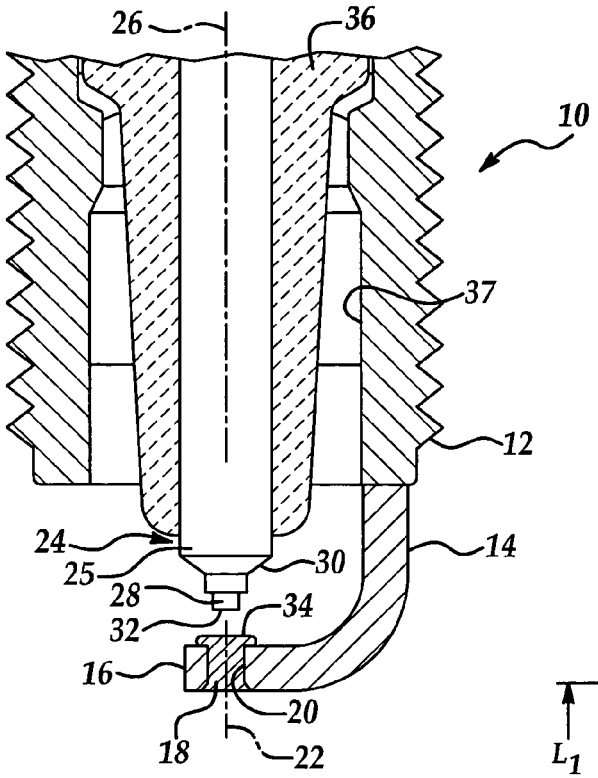
FIG. 1 is a fragmentary cross-sectioned view of a spark plug constructed according to one embodiment of the invention.

A fragmentary view of a spark plug constructed according to one presently preferred embodiment of the invention is shown in FIG. 1 generally at 10. The spark plug 10 has a metal shell or housing 12 with a ground electrode 14 extending therefrom. The ground electrode 14 is generally L-shaped and extends from a first end that is welded to shell 12 to a second free end 16. An electric discharge pad or firing tip 18 is received at least in part in a through hole 20 extending through the ground electrode 14 generally adjacent the free end 16. The firing tip 18 is mechanically retained within the through hole 20 by compressing the firing tip 18 axially along a longitudinal axis 22 to deform it radially and establish an interference fit between the firing tip 18 and the bore 20. To further secure the firing tip 18 to the ground electrode 14, the firing tip 18 is preferably welded to the ground electrode 14.

The spark plug 10 includes a number of other components that can be made and assembled in a conventional fashion. This includes a center electrode assembly 24 and insulator 36. The center electrode assembly 24 has a center electrode 25 extending along a central axis 26 of the spark plug 10 and can include additional components (not shown) such as one or more conductive, non-conductive, or resistive glass seals, capsule suppressors and an associated compression spring, as well as a terminal attached to the top end of the insulator 36. The center electrode 25 has a firing tip or electrical discharge member 28 extending from an end 30 of the center electrode 24 and terminating at a firing end 32. The firing end 32 of the center electrode firing tip 28 and an upper surface 34 of the ground electrode firing tip 18 define a spark gap of a predetermined distance. It is desirable to maintain the predetermined gap throughout the life of the spark plug 10 so that its performance will not degrade significantly. Insulator 36 is secured within a central bore 37 of the housing 12. The insulator 36 in turn includes a longitudinal bore in which center electrode assembly 24 is located.

Figure 2A:
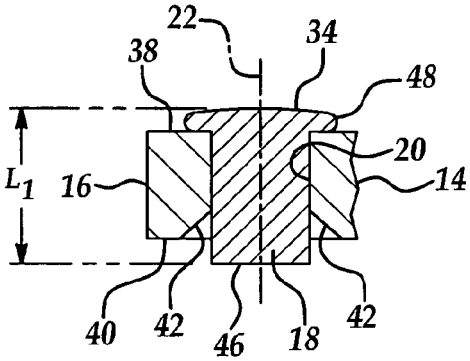
FIG. 2A is an enlarged fragmentary view of the spark plug of FIG. 1 showing a firing tip partially assembled to a ground electrode of the spark plug of FIG. 1.

As best shown in FIG. 2A, the firing tip 18 is partially assembled within the through hole 20 of the ground electrode 14. The ground electrode 14 is preferably fixed to the housing 12, such as through a resistance weld joint, and is preferably straight, and not yet bent into the L-shaped configuration shown in FIG. 1. In addition, the casing 12 and ground electrode 14 are preferably coated, for example with nickel or a nickel-based alloy, prior to inserting the firing tip 18 into the through 20. The ground electrode 14, has an upper surface 38 and a lower surface 40 generally parallel to one another with the through hole 20 extending between the upper and lower surfaces 38, 40. Preferably, a counterbore 42 is formed and extends from at least one of the upper and lower surfaces 38, 40, shown here as the lower surface 40 of the ground electrode 14, into the through hole 20 about 0.005–0.010". The counterbore 42 is shown having a tapered surface that is oblique relative to the upper surface 38, and preferably has a chamfer of about 15°–25° relative to axis 22, though it should be recognized other configurations may be desirable, for example a generally stepped configuration. The ground electrode 14 is preferably constructed from a nickel-based material, for example and without limitation, an Inconel or 836 alloy, and can be made with or without a copper core. With the through hole 20 formed in the ground electrode 14, the firing tip 18 is inserted within the through hole 20.

The firing tip 18 has an end 46 generally opposite the end 34 wherein a first length, represented as ($L_1$), is defined between the ends 34, 46 prior to the firing tip 18 being compressed. Preferably, the end 34 has an enlarged head 48 for abutting the upper surface 38 upon inserting the firing tip 18 into the through hole 20. As shown in FIG. 2A, the end 46 of the firing tip 18 extends below the lower surface 40 of the ground electrode 14 preferably about 0.030"–0.040" prior to compressing the firing tip 18 within the bore 20.

Figure 2B:
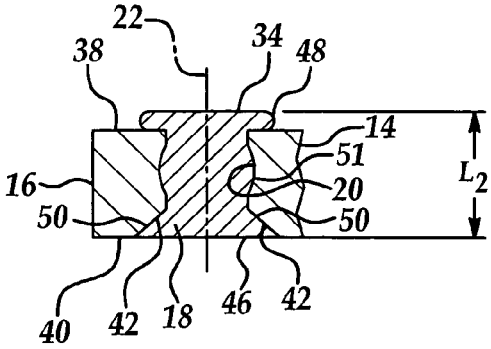
FIG. 2B is a view similar to FIG. 2A with the firing tip fully assembled to the ground electrode.

Upon inserting the firing tip 18 at least in part within the through hole 20, the head 48 is preferably maintained in contact with the upper surface 38, while the end 46 is axially compressed along the longitudinal axis 22 to define a flared portion 50 of the firing tip 18 (FIG. 2B). Preferably, the head 48 is backed-up by a generally fixed surface while compressing the end 46 of the firing tip 18 generally toward the head 48 along the axis 22. Generally, the axial force to compress the firing tip 18 is in a range of about 300 lbs.–380 lbs., and preferably within a range of 320 lbs.–360 lbs. This axial compression of the firing tip 18 expands the firing tip material at end 46 outwardly to thereby form the flared portion 50. Upon completing the compression of the firing tip 18, the firing tip 18 has a second length, wherein the second length, represented here as ($L_2$), is shorter than the first length ($L_1$) of the firing tip 18. Preferably, the end 46 is compressed to a degree such that it is generally flush with the lower surface 40. The head 48 preferably presents an enlarged surface area having a diameter of approximately 0.120"–0.125" to further enhance maintaining the gap and thus, extending the life of the spark plug 10.

The enlarged head 48 and flared portion 50 form a first mechanical interlock. These features 48, 50 together retain the firing tip 18 in position by abutting opposing surfaces of the ground electrode. In addition to this first mechanical interlock, a bulging portion 51 is also formed during the compression operation. The bulging portion 51 is located generally between the head 48 and the flared portion 50 of the firing tip and bulges, or extends, radially outwardly about 0.005"–0.010" on the radius. The bulging portion 51 further retains the firing tip 18 in position by creating additional interference (i.e., a second mechanical interlock) with the ground electrode 14 within the through hole 20. Either this first mechanical interlock or the second mechanical interlock, or both, can be used without departure from the scope of the invention.

Figure 3:
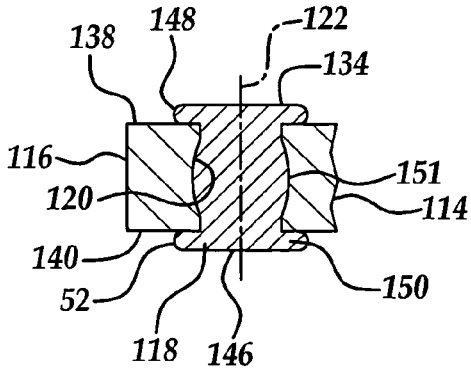
FIG. 3 is a view similar to FIG. 2B showing an alternative embodiment of the invention.

In the alternate embodiment shown in FIG. 3, similar features as the embodiment above are given similar reference numerals, but are offset by 100. A firing tip 118 is inserted within a generally straight through hole 120 and, upon being compressed, another head 52 is formed generally opposite a head 148 such that the head 52 defines a spaced or enlarged portion 150 to mechanically retain the firing tip 118 within the bore 120. Otherwise, the embodiment shown in FIG. 3 functions similarly as the embodiment of FIG. 2B and preferably includes a bulging portion 151 that extends radially into a widened center portion of through hole 120.

Upon compressing the firing tip 18, 118 within the bore 20, preferably the firing tip is welded to the ground electrode 14, 114 to provide yet another redundant interlocking of the firing tip 18 within the bore 20. Preferably, a resistance weld is used to impart a weld joint between the ground electrode 14, 114 and the firing tip 18, 118 in both the area of the head 48, 148 and the compressed or coined end 46, 146. Other suitable welding processes may be used to impart the weld joint, for example, a laser welding process can be used to form a stitch around the head 48, 148.

Once the firing tip 18, 118 is permanently attached to the through hole 20, 120 and the ground electrode 14, 114 is attached to the spark plug shell 12, the gap can be established between the end 34, 134 of the firing tip 18, 118 and the firing end 32 of the electrical discharge member 28 by bending the ground electrode 14, 114 to the generally L-shape form. With the firing tip 18, 118 mechanically retained, the gap can be maintained and the life of the spark plug 10 can be extended in use. To further enhance the useful life of the spark plug 10, it should be recognized that the firing tip 18, 118 is constructed from materials that resist erosion, for example iridium based materials, platinum based materials, and the like.

Although disclosed embodiment of firing tip is cylindrical, it will be understood that it can have other cross-sectioned shapes, including oval or other curved shapes or rectangular or other polygonal shapes, and that in such instances the term "radial" and its other forms do not require a cylindrical or curved shape but instead refer to a direction orthogonal to longitudinal axis of the tip.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A method of constructing a ground electrode (14, 114) for a spark plug (10) comprising the steps of:

providing a segment of metal wire having an upper surface (38, 138) and a lower surface (40, 140);

forming a through hole (20, 120) in the wire, said through hole (20, 120) extending between and opening to each of said upper (38, 138) and lower (40, 140) surfaces;

providing a firing tip (18, 118) having a longitudinal axis;

inserting the firing tip (18, 118) within the through hole (20); and compressing the firing tip (18, 118) in the direction of its longitudinal axis such that a first end (46, 146) of the firing tip (18, 118) flares outwardly from the longitudinal axis and a bulging portion (51, 151) is formed inside the through hole (20, 120) between the upper (38, 138) and lower (40, 140) surfaces of the wire.

2. The method of claim 1, including forming an enlarged head (48, 148) on a second end of the firing tip (18, 118) wherein the enlarged head (46, 146) abuts an outer surface of the wire upon inserting the firing tip (18, 118) within the through hole (20, 120).

3. The method of claim 1, further comprising forming a weld joint between the firing tip (18, 118) and the metal wire.

4. The method of claim 3, wherein resistance welding is performed to construct the weld joint.

5. The method of claim 3, wherein laser welding is performed to construct the weld joint.

6. The method of claim 1, further comprising forming a counterbore (42) extending from at least one of the surfaces into the metal wire and wherein said compressing step further comprises compressing the firing tip (18) to cause the first end (46) to flare outwardly into the counterbore (42).

7. A method of making a spark plug, comprising the steps of:

installing a center electrode assembly (24) within an insulator (36);

providing a metal shell (12) having a central bore (37) sized to receive said insulator (36);

forming a ground electrode (14, 114) having a through hole (20, 120) adjacent one end thereof, said ground electrode (14, 114) having an upper surface (38, 138) and a lower surface (40, 140) with said through hole (20, 120) extending between and opening to each of said upper (38, 138) and lower (40, 140) surfaces;

inserting a firing tip (18, 118) having a longitudinal axis into said through hole (20, 120);

compressing said firing tip (18, 118) in the direction of said longitudinal axis until said firing tip (18, 118) undergoes deformation within said through hole (20, 120) at a location between said upper (38, 138) and lower (40, 140) surfaces;

attaching said ground electrode (14, 114) to said metal shell (12); and securing said insulator (36) and center electrode assembly (24) within said central bore (37) of said metal shell (12).

8. The method of claim 7, wherein said forming step further comprises forming said ground electrode (14) such that said through hole (20) has a counterbore (42) at a surface of the ground electrode (14).

9. The method of claim 8, wherein said compressing step further comprises compressing said firing tip (18) such that it flares out into said counterbore (42).

10. The method of claim 9, wherein said inserting step further comprises inserting a firing tip (18) having an enlarged head (48) until said head engages an outer surface of said ground electrode (14) opposite said counterbore (42).

11. The method of claim 7, wherein said compressing step further comprises compressing said firing tip (18, 118) such that it bulges outwardly within said through hole (20, 120) and deforms a center portion of said through hole (20, 120) outwardly, whereby said firing tip (18, 118) is mechanically interlocked to said ground electrode (14, 114).

12. The method of claim 7, further comprising the step of welding said firing tip (18, 118) to said ground electrode (14, 114).

13. The method of claim 7, wherein said providing step is carried out prior to said installing step.

* * * * *